US010777892B2

(12) United States Patent
Nikles et al.

(10) Patent No.: US 10,777,892 B2
(45) Date of Patent: Sep. 15, 2020

(54) ANTENNA

(71) Applicant: Sivantos Pte. Ltd., Singapore (SG)

(72) Inventors: Peter Nikles, Erlangen (DE); Robert Felsmann, Hausen (DE)

(73) Assignee: Sivantos Pte. Ltd., Singapore (SG)

( * ) Notice: Subject to any disclaimer, the term of this patent is extended or adjusted under 35 U.S.C. 154(b) by 106 days.

(21) Appl. No.: 16/124,945

(22) Filed: Sep. 7, 2018

(65) Prior Publication Data

US 2019/0006757 A1 Jan. 3, 2019

Related U.S. Application Data

(63) Continuation of application No. PCT/EP2017/055020, filed on Mar. 3, 2017.

(30) Foreign Application Priority Data

Mar. 7, 2016 (DE) ..... 10 2016 203 690
May 30, 2016 (DE) ..... 10 2016 209 332

(51) Int. Cl.
*H01Q 7/06* (2006.01)
*H01Q 1/27* (2006.01)
*H04R 25/00* (2006.01)

(52) U.S. Cl.
CPC ..... *H01Q 7/06* (2013.01); *H01Q 1/273* (2013.01); *H04R 25/552* (2013.01); *H04R 25/554* (2013.01); *H04R 25/558* (2013.01); *H04R 2225/021* (2013.01); *H04R 2225/023* (2013.01); *H04R 2225/025* (2013.01); *H04R 2225/51* (2013.01)

(58) Field of Classification Search
CPC ..... H01Q 7/06; H01Q 7/08; H04R 25/554
See application file for complete search history.

(56) References Cited

U.S. PATENT DOCUMENTS 5,567,537 A 10/1996 Yoshizawa et al.
7,508,350 B2 3/2009 Hein et al.
7,777,680 B2 8/2010 Abe et al.
(Continued)

FOREIGN PATENT DOCUMENTS

CN 101405665 A 4/2009
DE 11 2004 000 520 T5 3/2006
(Continued)

OTHER PUBLICATIONS

Vacuumschmelze: "Soft Magnetic Materials and Semi-finished Products", Jan. 1, 2002, pp. 1-30, XP055375946.
(Continued)

*Primary Examiner* — Daniel Munoz
(74) *Attorney, Agent, or Firm* — Muncy, Geissler, Olds & Lowe, P.C.

(57) ABSTRACT

An antenna, in particular for a hearing aid, for wireless radio communication, comprising a coil core which extends along a longitudinal direction and carries a number of windings, and comprising a planar first shield that is located on an end face of the coil core and is made of a ferrimagnetic and/or ferromagnetic material. The first shield extends at an angle to the longitudinal direction of the coil core. The invention further relates to a method for manufacturing an antenna as well as to a hearing aid comprising an antenna.

24 Claims, 5 Drawing Sheets

(56) References Cited

U.S. PATENT DOCUMENTS

| | | | | |
|---|---|---|---|---|
| 8,059,053 | B2 | 11/2011 | Miyazaki et al. | |
| 2006/0022886 | A1* | 2/2006 | Hein | B82Y 25/00 343/787 |
| 2006/0109071 | A1 | 5/2006 | Thongsouk et al. | |
| 2011/0235837 | A1* | 9/2011 | Huttinger | H04R 25/65 381/328 |
| 2014/0363037 | A1* | 12/2014 | Nikles | H01Q 1/22 381/328 |

FOREIGN PATENT DOCUMENTS

| | | | |
|---|---|---|---|
| EP | 1 906 270 | A2 | 4/2008 |
| EP | 2 009 518 | A1 | 12/2008 |
| WO | WO 2004/066438 | A1 | 8/2004 |
| WO | WO2005088771 | A1 | 9/2005 |

OTHER PUBLICATIONS

Chinese Office Action dated Sep. 23, 2019 in corresponding application 201780015926.x.

* cited by examiner

ANTENNA

This nonprovisional application is a continuation of International Application No. PCT/EP2017/055020, which was filed on Mar. 3, 2017, and which claims priority to German Patent Application No. 10 2016 203 690.4, which was filed in Germany on Mar. 7, 2016 and to German Patent Application No. 10 2016 209 332.0, which was filed in Germany on May 30, 2016, and which are both herein incorporated by reference.

BACKGROUND OF THE INVENTION

Field of the Invention

The invention relates to an antenna for wireless radio communication. The antenna is in particular a component of a hearing device. The invention further relates to a method for manufacturing an antenna and a hearing device comprising an antenna. The hearing device is preferably a hearing aid.

Description of the Background Art

Persons who suffer from a reduction in hearing ability usually use a hearing aid. In this case, an ambient sound is usually detected by means of an electromechanical acoustic transducer. The detected electrical signals are processed by an amplifier circuit and introduced into the ear canal of the person by a further electromechanical transducer. Various types of hearing aids are known. The so-called "behind-the-ear devices" are worn between the skull and the auricle. In this case, the amplified sound signal is introduced into the ear canal by means of a sound tube. A further common design of a hearing aid is an "in-the-ear device" in which the hearing aid itself is inserted into the ear canal. Consequently, the ear canal is at least partially closed by this hearing aid, so that, apart from the sound signals generated by the hearing aid, no other sound can penetrate into the ear canal or only to a greatly reduced extent.

If the person suffers from a hearing impairment in both ears, a hearing device system with two such hearing aids is used. Here, each of the ears is assigned to one of the hearing aids. In order to enable spatial hearing for a person, it is necessary that the audio signals detected by one of the hearing aids are provided to the other hearing aid. Here, the head of the person acts as damping in high-frequency transmissions, which is why the transmission rate between the hearing aids is limited. In addition, a transmit power is limited because of the limited energy storage of the hearing aids.

SUMMARY OF THE INVENTION

It is therefore an object of the present invention to provide an antenna for wireless radio communication, as well as a particularly suitable method for manufacturing an antenna and a particularly suitable hearing aid comprising an antenna, wherein in particular transmission quality and reception quality are improved, and wherein preferably a power requirement and/or a space requirement are reduced.

The antenna is suitable, in particular provided and/or designed, to be used in wireless radio communication. In other words, the antenna is used for wireless radio communication. Suitably, the antenna is part of a hearing device. For example, the hearing device is an earphone or comprises an earphone. However, the hearing device is particularly preferably a hearing aid. The hearing aid is used to assist a person suffering from a reduction in hearing ability. In other words, the hearing aid is a medical device by means of which, for example, partial hearing loss is compensated. The hearing aid is, for example, a "receiver-in-the-canal" hearing aid (RIC), an in-the-ear hearing aid, an "in-the-canal" hearing aid (ITC), or a "completely-in-canal" hearing aid (CIC), hearing aid glasses, a pocket hearing aid, a bone conduction hearing aid, or an implant. The hearing aid is particularly preferably a behind-the-ear hearing aid, which is worn behind an auricle.

The antenna has a coil core extending along a longitudinal direction. The coil core has a number of turns, which are made of an electrically conductive material, such as copper-nickel, aluminum, or copper. In particular, the turns are made of enameled wire, such as a copper enameled wire or a copper-nickel enameled wire. In this case, the turns surround the coil core, for example, circumferentially along the full extent in the longitudinal direction. Especially preferably, however, the coil core projects on at least one side, preferably on two sides, with respect to the turns in the longitudinal direction. For example, the number of turns is between 2 turns and 200 turns, between 10 turns and 150 turns, between 20 turns and 100 turns, between 40 turns and 80 turns, and, for example, substantially equal to 60 turns, wherein, for example, there are deviations of 5 turns, 2 turns, or no turn. The turns expediently extend substantially in a mutually parallel plane, which is perpendicular to the longitudinal direction, and/or all turns are preferably formed next to each other. In other words, in particular, the turns are made in one piece from a component part, preferably from a wire, such as the enameled wire. Suitably, the turns are electrically contacted with electronics.

The antenna further has a planar first shield, which is arranged on an end face of the coil core, wherein the end face in particular forms a boundary of the coil core in the longitudinal direction. The first shield extends substantially in one plane, in particular along a spatial direction. The first shield thus extends at least along a surface whose curvature is relatively low or 0 (zero). At least the main dimension of the first shield in one, preferably two directions is in particular at least two times, preferably five times, or more than ten or twenty times greater than in another spatial direction. The directions are expediently perpendicular to each other. Preferably, the surface of the first shield is smooth.

The first shield is located on the end face of the coil core and is thus offset with respect to the coil core in the longitudinal direction. Suitably, when projected onto the first shield in the longitudinal direction, the end face is completely or at least partially surrounded by the first shield and is thus imaged by it. In other words, a projection of the coil core in the longitudinal direction is at least partially, preferably completely, covered by the first shield. The shape of the first shield is, for example, round, rectangular, or otherwise configured. The first shield extends at an angle to the longitudinal direction of the coil core. In other words, the plane within which the shield is located encloses an angle to the longitudinal direction that is different from zero (0). In other words, the plane is not parallel to the longitudinal direction. The first shield is made of a ferrimagnetic and/or ferromagnetic material. For example, the first shield is made of the same material as the coil core.

Due to the first shield, the transmission quality and reception quality of the antenna are improved, because with an inductive transmission with a constant antenna volume, the ratio of the length of the antenna to its diameter determines the performance and thus the quality of the antenna. The length of the antenna is increased because of the first shield, wherein the diameter surrounded by the turns is not increased. In fact, due to the first shield, the magnetic field lines are directed so that they enclose an angle with respect to the longitudinal direction. In other words, the magnetic field feedback is changed due to the first shield. However, this effect is relatively weak compared with the increase in quality due to the extension of the magnetic field lines in the ferromagnetic or ferrimagnetic material of the first shield. In this case, due to the angling of the first shield with respect to the longitudinal direction, a space requirement in the longitudinal direction is reduced, so that a relatively compact antenna is provided, which can thus also be used in a hearing device.

For example, if the antenna is used in a hearing device, audio signals and/or setting data can be transmitted by it, for example, between two hearing devices, each of which has an antenna of this kind. Alternatively, for example, audio data and/or setting data are transmitted between a remote control and the hearing device having the antenna. Due to the improved quality, it is not necessary to operate the antenna with a relatively high power, which is why a power requirement is reduced. In particular, the antenna is operated with a power between 100 μW and 100 mW. Preferably, the effective antenna area is between 500 $mm^2$ and 6000 $mm^2$, and the inductance is preferably between 10 μH and 150 μH.

In particular, the antenna can be used for inductive radio communication. Preferably, the frequency range is between 1 kHz and 300 MHz, and particularly preferably between 100 kHz and 30 MHz. For example, the frequency range is between 2 MHz and 5 MHz and, for example, equal to 3.2 MHz. The first shield preferably has a length λ/4 with respect to a wavelength λ selected for radio communication, wherein material quantities such as a permittivity c and/or a permeability $\mu_R$ are expediently taken into account. For example, the antenna is used in addition to an inductive power transfer or power transfer that uses radio waves. In other words, power, which is used, for example, to charge an energy storage, is transmitted by means of the antenna. In particular, this use occurs when the antenna is part of the hearing device.

For example, the first shield is arranged at a distance of less than 300 μm, in particular less than 100 μm, or preferably less than 30 μm, to the end face of the coil core. The distance in this case is, for example, greater than 10 μm or 50 μm. Particularly preferably, however, the first shield adjoins the coil core without a gap. In particular, the first shield is electrically contacted with the coil core. Due to the relatively small distance, in particular due to the absence of a gap in the gap-free system, the formation of the magnetic field lines is further improved, which is why the quality of the antenna and thus its figure of merit are improved. In addition, the power requirement is reduced. For example, the first shield is integrally connected to the coil core, in particular by means of gluing or soldering. Alternatively, other fixing components can be are used, such as clips or the like. In this way, assembly is simplified and a space requirement is further reduced.

For example, the first shield is mortised with the end face of the coil core. In other words, either the first shield or the end face of the coil core has a tenon which is inserted or engages in a corresponding recess of the end face or the first shield. In this way, a shift of the first shield with respect to the coil core is prevented, which increases robustness. Preferably, the coil core comprises the tenon and thus engages in a corresponding recess of the first shield. Suitably, the tenon is reduced in cross section, in particular with regard to the cross section of the coil core in the region of the turns. In other words, the coil core is configured as step-like in the region of the end face, wherein the height of the step preferably corresponds substantially to the thickness of the first shield. Expediently, the size of the recess of the first shield corresponds to the reduced cross section of the coil core and is expediently smaller than the cross section of the coil core, with the exception of the tenon. Due to this, over-insertion of the coil core into the recess of the first shield is avoided, which further simplifies assembly and increases robustness. In a further alternative, the first shield is placed substantially flush on the end face of the coil core or at least arranged there. In other words, the first shield and the coil core have no mutually corresponding components, which interlock, for example. Thus, manufacturing of the first shield and the coil core is simplified.

For example, the shield has a thickness between 0.05 mm and 0.7 mm. In this case, the thickness in particular designates an extent of the first shield perpendicular to the plane in which the planar first shield extends, and/or which is parallel to the longitudinal direction. For example, the thickness is between 0.1 mm and 0.3 mm and preferably equal to 0.2 mm. Particularly preferably, the first shield is provided by means of a foil and is thus sheet-like. The first shield is expediently designed to be flexible, in particular elastically deformable, which simplifies installation of the antenna, in particular in a hearing device. If the first shield is created by means of a foil, manufacture is also simplified.

The shield can extend at an angle between 45° and 135° to the longitudinal direction, therefore, to the longitudinal direction of the coil core. In other words, the longitudinal direction and the plane in which the planar first shield extends enclose an angle between 45° and 135°. Particularly preferably, the angle is between 60° and 120° and suitably between 80° and 100°. For example, the first shield is arranged substantially at right angles, therefore, at an angle of 90°, to the longitudinal direction, wherein there is, for example, a deviation of up to 10°, 5°, 2°, or 0°. In other words, the antenna is at least partially configured substantially L-shaped. Due to the relatively large angle, the space requirement of the antenna in the longitudinal direction is relatively small and is substantially dictated solely based on the extent of the coil core. Thus, the antenna can also be arranged in a restricted space, as is the case, for example, with a hearing device. In addition, parts of the antenna can be arranged in regions that would otherwise not be usable.

The material of the first shield can have an electrical conductivity that is less than $10^6$ S/m (Siemens per meter). Preferably, the electrical conductivity (a) is less than 100 S/m and, for example, between 1 S/m and 50 S/m, between 5 S/m and 20 S/m, and substantially equal to 10 S/m, wherein there is, for example, a deviation of 5 S/m, 2 S/m, 1 S/m, or 0 S/m. Due to the relatively low electrical conductivity, formation of eddy currents in the first shield is reduced, which reduces the power loss. Alternatively or in combination, the magnetic permeability ($\mu_R$) of the first shield, which is a ferromagnetic or ferrimagnetic material, is greater than 5. For example, the magnetic permeability is greater than 100 and particularly preferably greater than 200, 500, or 1000. In this way, formation of the magnetic field line by the first shield is relatively efficient. Expediently, the electrical conductivity is less than $10^6$ S/m and the magnetic permeability greater than 5, and suitably the material of the first shield has an electrical conductivity of substantially 10 S/m and a magnetic permeability greater than 200. For example, the material of the first shield comprises a ferrite, therefore in particular an oxidized iron, and, for example, MnZn ferrite. Suitably, the material of the first shield, however, at least the ferrite, is a foil or forms at least one foil. In other words, the ferrite is present in foil form. This is also applied, for example, to a further component of the first shield, or the first shield is formed by a foil of this kind.

The antenna can have a first layer, which is arranged on the first shield's bottom side facing the coil core. In particular, the first layer is arranged substantially in the same plane as the first shield or a plane parallel thereto. Expediently, the first layer is connected to the bottom side. The first layer is made of a material having a magnetic permeability of $\mu_R$ less than 1000. In particular, the permeability is less than 100 and preferably less than or equal to 10 or less than or equal to 2. Preferably, the material of the first layer is different from that of the first shield. The first layer is in particular arranged partially on the bottom side of the first shield or arranged over its entire surface. In this case, however, the first layer is particularly preferably omitted in the longitudinal direction in the region of a projection of the end face of the coil core on the first shield. At a minimum, the region of projection of the end face in the longitudinal direction on the first shield is free of the first layer, irrespective of the size of the first layer. In other words, the first layer is omitted at least there. For example, the circumferential extent of the first layer is substantially equal to the circumferential extent of the first shield. Alternatively, the first shield overlaps the first layer at the edge or vice versa.

Due to the first layer, propagation of the magnetic field lines from the bottom side of the first shield toward the coil core is reduced, which substantially suppresses magnetic field feedback, which is why antenna efficiency is increased and thus a power requirement is reduced. In addition, shielding is provided due to the first layer, so that any electrical and/or electronic components arranged on the bottom side of the first shield are not or only slightly disturbed due to the magnetic fields. Also, such components during operation do not interfere with a signal-to-noise ratio of the antenna or interfere with it only to a relatively small extent. In particular, due to the first layer any magnetic fields are shielded, which are caused, for example, due to a current-carrying electrical conductor, such as a trace of a printed circuit board, which is arranged between the bottom side and the coil core, so that they contribute relatively little to antenna interference.

For example, the material of the first layer is a paramagnetic material and thus has a permeability greater than 1 ($\mu_r$>1). Alternatively, the material is a diamagnetic material and has a permeability between 0 and 1 ($0 \leq \mu_R < 1$. In this way, propagation of magnetic field lines away from the bottom side of the first shield is avoided relatively efficiently. Alternatively or particularly preferably in combination therewith, the electrical conductivity of the material of the first layer is greater than $10^6$ S/m (Siemens per meter) and particularly preferably greater than $10^7$ S/m. Preferably, the permeability of the first shield is greater than the permeability of the first layer and the electrical conductivity of the material of the first layer is greater than the electrical conductivity of the first shield. As a result, eddy currents are generated substantially only in the first layer, whereas the magnetic field lines are drawn into the first shield and thus substantially run there. Due to this, the sensitivity of the antennas is increased. The figure of merit of the antenna is also relatively high if a metallic further component, in particular of any hearing device, e.g., an electromechanical sound transducer (microphone), is arranged in the region of the bottom side, because there are essentially no eddy currents in the first shield and thus no eddy current losses arise.

Expediently, the material of the first layer is an aluminum or a copper, for example, pure aluminum or pure copper, or an aluminum alloy or copper alloy. In an alternative, the first layer is made of or comprises a low-permeability iron, a cobalt, a nickel, or a low-permeability stainless steel, such as MAGNADUR 3952, which has a permeability ≤1.02. In a further alternative, the material is an alloy comprising, for example, copper, aluminum, low-permeability iron, low-permeability stainless steel, cobalt, or nickel. Particularly preferably, the first layer is made of a diamagnetic copper or a paramagnetic aluminum. These two materials meet the requirements and are relatively inexpensive, which is why manufacturing costs are reduced.

Particularly preferably, the first layer is applied at a distance of less than 500 μm and preferably of less than 100 μm, and suitably at a distance of less than 50 μm to the bottom side of the first shield, wherein, for example, the distance is greater than 10 μm or 20 μm. Particularly preferably, the first layer is attached without a gap to the bottom side of the first shield. For example, the first layer is electrically contacted with the first shield. Due to the relatively small distance, the propagation of eddy currents within the first layer is improved, wherein the magnetic field lines run predominantly in the first shield. For example, the first layer is glued or vapor-deposited onto the first shield. Manufacture is further simplified in this way. Alternatively, the first layer is materially connected to the first shield, for example, by gluing or by metallization.

The thickness of the first layer is preferably between 5 μm and 0.7 mm, in particular between 15 μm and 150 μm, advantageously between 30 μm and 100 μm, or between 0.05 mm and 0.7 mm, wherein the thickness is expediently determined perpendicular to the main propagation direction and/or perpendicular to the plane within which the first layer is arranged. In particular, the direction in which the thickness is determined is parallel to the direction in which a thickness of the first shield is determined, and/or parallel to the longitudinal direction. Particularly preferably, the thickness is between 0.1 mm and 0.3 mm and, for example, substantially equal to 0.2 mm, wherein there is in particular a deviation of 10%, 5%, 2%, or 0%. Particularly preferably, the first layer is designed sheet-like and expediently is a foil. For example, the first layer is made elastically bendable and flexible. Due to the relatively small dimensions, the space requirement is low, which is why installation of the antenna is simplified. Particularly preferably, the first layer is made of a diamagnetic copper foil or a paramagnetic aluminum foil.

In particular, the first layer is used for electromagnetic radio communication. In other words, the antenna has two antenna systems, wherein one (first antenna system) is formed at least partially by the turns. The remaining antenna system (second antenna system) is at least partially formed by the first layer. The frequency range of the second antenna system in this case is expediently between 800 MHz and 50 GHz and, for example, between 1 GHz and 30 GHz. The length of the first layer with respect to the wavelength selected for radio communication, therefore, for example, 3 GHz, preferably has a length of $\lambda/4$, therefore, substantially between 2 and 2.5 cm. Suitably, in this case the length of the first shield is substantially at least equally great. By means of the first layer, a so-called patch antenna is in particular partially formed, therefore, in particular a planar monopole.

For example, the length of the coil core in the longitudinal direction is between 2.0 mm and 8.0 mm, preferably between 3.0 mm and 7.0 mm, and particularly preferably between 3.5 mm and 5.5 mm. In this way, a relatively compact antenna is created, which can also be placed in a hearing device. In this case, the longitudinal direction is, for example, perpendicular or substantially perpendicular to a viewing direction of the hearing device wearer. For example, the coil core is made hollow. In other words, the coil core is hollow cylindrical, wherein the hollow extends substantially in the longitudinal direction. Particularly preferably, the coil core is made of a soft magnetic material, such as, for example, a soft magnetic ferrite, and preferably is formed thereof. In particular, the coil core has a chamfer, which expediently extends in the longitudinal direction. Due to the chamfer, it is possible to influence a coupling of magnetic field lines in the coil core and thus to determine a preferred direction of the antenna.

Suitably, the coil core is cylindrical, wherein a cross section of the coil core perpendicular to the longitudinal direction is round, for example. In particular, the cross section is completely or partially filled by the coil core, so that either a hollow cylindrical or a solid cylindrical coil core is provided. The diameter of the circle is, for example, between 0.05 mm and 3.0 mm and suitably between 0.5 mm and 2.5 mm. For example, the diameter is between 1.0 mm and 1.5 mm. Due to the round cross section, damage to the turns during assembly is substantially excluded, wherein due to the diameter a relatively compact coil core is provided, which is why a space requirement is reduced. In addition, because of the small diameter, the ratio of the length of the antenna to the diameter is relatively large, which is why a quality of the antenna at a given antenna volume is improved.

In an alternative, the coil core has a rectangular cross section perpendicular to the longitudinal direction, and the coil core is thus configured substantially cuboid. In this case, one side of the cross section expediently has a length between 0.05 mm and 3.0 mm, for example, between 0.05 mm and 2.5 mm, in particular between 0.1 mm and 2.0 mm, and preferably between 0.3 mm and 1.5 mm. In particular, the height of the cuboid coil core is thus between 0.3 mm and 1.5 mm. Alternatively or in combination therewith, the other side has a length between 0.3 mm and 8.0 mm, in particular between 0.5 mm and 6.0 mm, and preferably between 1.0 mm and 5.0 mm. In other words, the width of the cuboid coil core is between 1.0 mm and 5.0 mm.

Particularly preferably, the antenna has a second shield, which is designed planar and is preferably made of a ferrimagnetic and/or ferromagnetic material. The second shield is arranged on the coil core end face facing away from the first shield, and the second shield extends at an angle to the longitudinal direction of the coil core. The second shield is designed planar and thus preferably extends substantially in a plane or has only relatively small deviations from the plane. However, at least the extent of the second shield in one, preferably two spatial directions is greater than in a third spatial direction, wherein the spatial directions are arranged perpendicular to each other. In particular, in this case, the extent is two times, five times, ten times, or twenty times greater. Preferably, the projection of the end face in the longitudinal direction is at least partially, preferably completely covered by the second shield. Due to the second shield, the transmission quality and reception quality of the antenna are improved.

For example, the second shield is structurally identical and/or symmetric to the first shield, wherein the plane of symmetry runs expediently perpendicular to the longitudinal direction between the two shields. Particularly preferably, the second shield is made of the same material as the first shield. In particular, the angle which the second shield encloses relative to the longitudinal direction is equal to the angle of the first shield, wherein a U-shape is preferably formed by the two shields and the coil core. However, the two shields are arranged at least in a V-shape to each other and are expediently not parallel, provided that at least one of the shields is not arranged perpendicular to the longitudinal direction. Suitably, the first shield and the second shield extend wing-like along the same spatial direction, starting from the respective end face of the coil core. For example, the second shield is mortised with the coil core and expediently adjoins the coil core without a gap. The thickness of the second shield is preferably between 0.05 mm and 0.7 mm and the permeability is expediently greater than 5, wherein the electrical conductivity is less than $10^6$ S/m. In particular, the second shield is designed like a foil and is in particular a foil.

A second layer made of a material having a magnetic permeability of less than 1000 can also be arranged at least partially on the bottom side of the second shield, said side facing the coil core. In particular, the conductivity of the material of the second layer is greater than $10^6$ S/m. The second layer is preferably attached without a gap on the bottom side of the second shield and/or is preferably a foil. Expediently, the second layer is substantially structurally identical to the first layer and is suitably made of the same material as the first layer. Preferably, the arrangement of the second layer with respect to the second shield is substantially a mirror image of the arrangement of the first layer with respect to the first shield, wherein the plane of symmetry runs expediently perpendicular to the longitudinal direction between the two shields. In other words, the second layer is arranged symmetrically to the first layer with respect to a mirror plane running perpendicular to the longitudinal axis. Thus, a shielded spatial region is created between the two shields by the two layers, so that any electrical and/or electronic components positioned there and electrical conductors are not disturbed or disturbed only relatively slightly due to a magnetic field of the antenna. Also, such components have a relatively low interfering effect on the antenna, which is why a signal-to-noise ratio is increased.

The first layer and the second layer can be electrically connected to one another, for example, by means of a preferably planar shorting bar. Suitably, the connection is located outside the turns. Expediently, a second antenna system is formed by the two layers and the connection, or the second antenna system comprises at least the two electrically interconnected layers. These are preferably used for electromagnetic radio communication. The frequency range is expediently in each case between 800 MHz and 50 GHz, preferably between 1 GHz and 6 GHz, and in particular substantially between 2 GHz and 4 GHz, and is, for example, 2.4 GHz or 3.2 GHz. Suitably, the or each shield or the or each layer has a length of $\lambda/4$, based on a wavelength $\lambda$ selected for each radio communication, taking into account material quantities, in particular the permittivity c and/or the permeability $\mu$.

The antenna in the region of the coil core can comprise a base point for the (electrical) connection to ground, in particular to the device ground, provided that the antenna is used in a hearing device. Suitably, an electrical conductor, by means of which the two layers are electrically contacted with each other (shorting bar), is electrically connected to the base point or forms the base point. As a result, it is possible to adjust a resonance of the antenna formed by the two shields and thus to adjust the efficiency of the second antenna system.

The first shield and the coil core can be formed as a continuous foil structure. For example, the first shield and the coil core are made of two foils that are joined together. Particularly preferably, however, the first shield and the coil core are made of a single foil and are thus integral with each other. Expediently, the angling of the first shield relative to the coil core is realized by means of folding. In other words, the foil structure is folded. For example, the antenna has the second shield, which is also part of the foil structure, and thus associated with the first shield and the coil core. The foil structure is, for example, a single-layer or multilayer foil, wherein at least one of the layers expediently comprises a ferrimagnetic and/or ferromagnetic material, in particular a metallic ferrite, and preferably is formed thereof. For example, this layer is applied to a carrier material or the carrier material is formed by the ferrimagnetic or ferromagnetic material. The foil structure expediently has an electrically conductive region.

The antenna in the region of the turns can have a printed circuit board, which is connected to the coil core, for example, attached thereto. In this case, the turns surround the circuit board and the foil structure on the periphery, so that the turns wind at least partially around the circuit board. The coil core is stabilized due to the circuit board; this simplifies winding and thus attaching of the turns. The circuit board is, for example, a glass fiber-reinforced epoxy resin or a reinforced paper. Particularly preferably, the circuit board comprises an electrical terminal, in particular two electrical terminals, wherein at least one of the turns, expediently two of the turns, are electrically (directly) contacted with the electrical terminals, for example, by means of bonding. In this way, energization and/or tapping of an electrical voltage at the turns are simplified and contact with electronics is simplified. In summary, a circuit board, which (jointly) carries the turns and which carries the electrical terminals connected to the turns, is arranged in the region of the coil core.

The foil structure, for example, in the region of the coil core, can have at least partially a first layer, a second layer, and a third layer. In other words, the foil structure is formed with at least three layers. The three layers are stacked on top of each other and expediently fixed together, for example, by means of lamination. Alternatively, the layers are applied by means of coating, for example, to one of the layers or another carrier structure. Here, the second layer is arranged between the first layer and the third layer. The coil core is at least partially formed by the second layer. In particular, the second layer is made of a soft magnetic (permeable) material, in particular a soft magnetic ferrite, or at least comprises it. The turns are preferably formed by the first layer and the third layer. In this case, the first layer and the third layer particularly preferably have traces which are interconnected by means of vias. Preferably, the foil structure comprises one, preferably two auxiliary layers, which are arranged adjacent to the second layer between the first layer and the third layer, and surround the second layer, for example, at the edge. The via expediently runs in the auxiliary layers. Thus, the second layer is substantially completely surrounded, so that damage is prevented. For example, the foil structure is designed in three layers only in the region of the coil core. Particularly preferably, the foil structure is designed completely in three layers, so that the foil structure can be separated out of a bulk or sheet product without relatively large lamination processes or the like being subsequently necessary.

The method for manufacturing the antenna provides that in a first step, a foil-like sheet or bulk product is provided. The sheet or bulk product is formed like a foil and has, for example, one or more layers. In particular, at least one of the layers or the entire sheet or bulk product is made of a ferrimagnetic and/or ferromagnetic material. In a further step, the foil structure is separated from the sheet or bulk product. For example, the foil structure is punched or cut from the sheet or bulk product, for example, by means of laser cutting or a cutter. The foil structure is designed in particular substantially L-shaped or U-shaped, wherein the two mutually parallel legs will form the two shields of the antenna, and the middle part expediently at least partially the coil core. For example, the turns are subsequently applied to the foil structure, in particular in the region which will form the coil core. In particular, the turns are also applied in the region which will form at least part of one of the shields, preferably each shield. Suitably, the circuit board is first attached to the foil structure. Alternatively, for example, plating through takes place between two of the layers of the foil structure to form the turns. In a further step, the first shield, in particular the second shield as well, if present, are angled with respect to the longitudinal direction of the coil core. In other words, the foil structure is angled, in particular bent, so that the first shield and the coil core or the second shield are provided. For example, a fold is introduced into the foil structure to form the first shield and the coil core.

For example, the hearing device can be an earphone or comprises an earphone. However, the hearing device is particularly preferably a hearing aid. The hearing aid is used to assist a person suffering from a reduction in hearing ability. In other words, the hearing aid is a medical device by means of which, for example, partial hearing loss is compensated. The hearing aid is, for example, a "receiver-in-the-canal" hearing aid (RIC), an in-the-ear hearing aid, an "in-the-canal" hearing aid (ITC), or a "completely-in-canal" hearing aid (CIC), hearing aid glasses, a pocket hearing aid, a bone conduction hearing aid, or an implant. The hearing aid is particularly preferably a behind-the-ear hearing aid, which is worn behind an auricle.

The hearing device comprises an antenna for wireless radio communication. The antenna has a coil core which extends along a longitudinal direction and carries a number of turns, as well as a planar first shield of a ferrimagnetic and/or ferromagnetic material, which extends at an angle to the longitudinal direction of the coil core and is arranged on an end face of the coil core. The antenna preferably has the first layer, suitably both layers, and electrical and/or electronic components are arranged in an interspace between the layers of the diamagnetic or paramagnetic material; these components are in particular electromagnetically interfering components, in particular radiating traces, capacitors, and/or a digital signal processor. Consequently, an installation space is used relatively efficiently, wherein an influence on the antenna and the components is reduced due to the two layers. Suitably, the antenna is used for inductive radio communication, for which the turns are used. In this case, the frequency range is expediently between 1 kHz and 300 MHz, preferably between 100 kHz and 30 MHz. In addition, the antenna is used for electromagnetic radio communication, for which purpose the two layers are used in particular, which are preferably electrically contacted with each other by means of the shorting bar. In this case, the frequency range is expediently between 800 MHz and 50 GHz, preferably between 1 GHz and 6 GHz.

The antenna, in particular independently of the hearing device but particularly preferably as part of the hearing device, can be used for inductive radio communication, wherein expediently a frequency range between 1 kHz and 300 MHz, preferably between 100 kHz and 30 MHz, is employed and used at the same time for electromagnetic radio communication, wherein the frequency range here is between 800 MHz and 50 GHz, in particular between 1 GHz and 6 GHz. For example, the two radio communications are used at the same time or successively in time. In other words, data are transmitted inductively or electromagnetically by means of the antenna at the same time or subsequently in time.

The invention further relates to a hearing device system, which comprises, for example, two hearing devices with such an antenna, wherein the two hearing devices are at least temporarily coupled with each other by signals. In this case, the wireless radio communication is preferably used by means of which, in particular, data and/or settings are transmitted between the two hearing devices. Expediently, the data transmission takes place inductively, and the turns are preferably used for this purpose. Alternatively or in combination therewith, the hearing device system comprises a remote control, which is coupled by signals to at least one of the hearing devices or the hearing device by means of the wireless radio communication. In this case, an inductive transmission of data, such as configuration data or audio signals, expediently takes place. The hearing device system preferably comprises a smartphone or can be coupled with a smartphone by signals. Expediently, a wireless radio communication with the smartphone occurs by means of the antenna, wherein, for example, the possibly existing second antenna system is used, which suitably has at least one layer. In particular, this antenna system is substantially used to receive data, and the frequency range is expediently greater than 1 GHz. Because a relatively large frequency is used, relatively many data can be transmitted within a short time.

For example, the antenna can be used in addition to the inductive power transfer, so that in a certain operating mode charging of an energy storage of the hearing device is possible by means of the antenna. Suitably, the antenna thus has three operating modes, wherein the first operating mode comprises an inductive radio communication, the second operating mode the electromagnetic radio communication, and the third operating mode the inductive charging. In this case, the second operating mode is carried out, for example, simultaneously with the first operating mode and/or the third operating mode, wherein the first operating mode and the third operating mode advantageously alternate.

The hearing device system can be a hearing aid system. The hearing aid system is used to assist a person suffering from a reduction in hearing ability. In other words, the hearing aid system is a medical device by means of which, for example, partial hearing loss is compensated. The hearing aid system expediently comprises a behind-the-ear hearing aid worn behind an auricle, a "receiver-in-the-canal" hearing aid (RIC), an in-the-ear hearing aid, an "in-the-canal" hearing aid (ITC), or a "completely-in-canal" hearing aid (CIC), hearing aid glasses, a pocket hearing aid, a bone conduction hearing aid, or an implant. The hearing device system is in particular provided and designed to be worn on the human body. In other words, the hearing device system preferably comprises a holding device, by means of which attachment to the human body is made possible. Provided the hearing device system is a hearing aid system, at least one of the hearing devices is provided and designed to be placed, for example, behind the ear or within an auditory canal. In particular, the hearing device system is cordless and intended and designed to be inserted at least partially into an auditory canal. Particularly preferably, the hearing device system comprises an energy storage, by means of which a power supply is provided.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
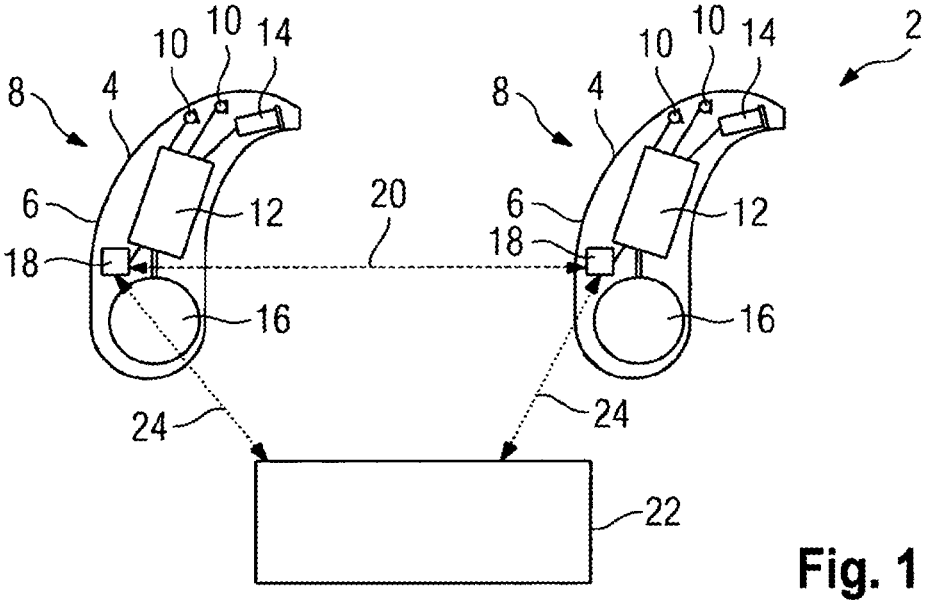
FIG. 1 shows schematically a hearing device system with two hearing devices, each comprising an antenna.

In FIG. 1, a hearing device system 2 is shown with two structurally identical hearing aids 4, which are provided and designed to be worn behind an ear of a user (wearer). In other words, these are in each case behind-the-ear hearing aids (behind-the-ear hearing aid), which have a sound tube (not shown), which is inserted into the ear. Each hearing aid 4 comprises a housing 6, which is made of a plastic. A microphone 8 with two electromechanical sound transducers 10 is arranged within housing 6. It is possible to change a directional characteristic of microphone 8 using the two electromechanical sound transducers 10 by changing a time offset between the acoustic signals detected by the respective electromechanical sound transducer 10. The two electromechanical sound transducers 10 are coupled by signals to a signal processing unit 12 which comprises an amplifier circuit. Signal processing unit 12 is formed by circuit elements, such as electrical and/or electronic components.

Furthermore, a loudspeaker 14 is coupled by signals to signal processing unit 12, said loudspeaker by means of which the audio signals picked up by microphones 8 and/or processed by signal processing unit 12 are output as sound signals. These sound signals are conducted by means of the sound tube (not shown in detail) into the ear of a user of hearing device system 2. The energization of signal processing unit 12, microphone 8, and loudspeaker 14 of each hearing aid 4 is effected by means of a respective battery 16. Each hearing aid 4 further has an antenna 18, by means of which a wireless radio communication 20 between the two hearing aids 4 is created. Wireless radio communication 20 serves to exchange data and takes place inductively. Due to the exchange of data, it is possible to impart a spatial sense of hearing to the wearer of hearing device system 2. In summary, hearing device system 2 is designed binaurally.

Further, hearing device system 2 comprises a further device 22, which is, for example, a remote control or a smartphone. This has a communication device (not shown in detail), by means of which a further wireless radio communication 24 is created with the two antennas 18 of the two hearing devices 4. Wireless radio communication 24 serves to exchange data between further device 22 and hearing aids 4. In particular, in this case audio signals are transmitted, which were detected by means of further device 22. Wireless radio communication 24 is a radio link and thus electromagnetic. In other words, a far field is used for communication.

Figure 2:
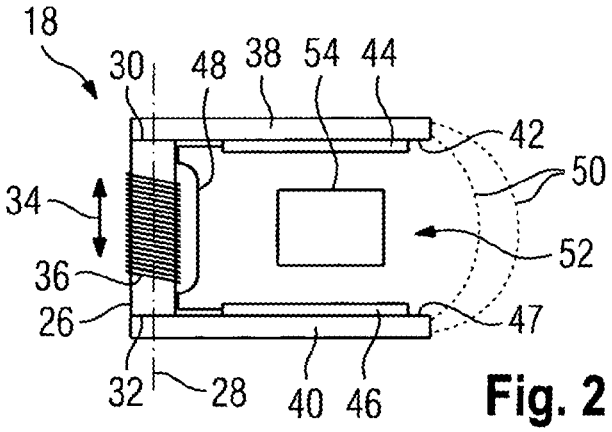
FIGS. 2-16 each show embodiments of the antenna.

In FIG. 2, antenna 18 is shown in greater detail in a top plan view, which is used in each of the two hearing devices 4. Antenna 18 has a coil core 26, which is made of a soft magnetic material or at least comprises a soft magnetic material, in particular a soft magnetic ferrite. Coil core 26 is made cylindrical and extends along a longitudinal axis 28. Thus, coil core 26 has a first end face 30 and a second end face 32, which delimit coil core 26 in a longitudinal direction 34 that is parallel to longitudinal axis 28. The extent of coil core 26 in longitudinal direction 34 is between 4 mm and 6 mm and equal to 5 mm. Coil core 26 carries a number of turns 36 which form a coil, wherein the coil is located substantially in the center on coil core 26, so that the two end faces 30, 32 are distanced in the longitudinal direction 34 from the coil core. Turns 36 are formed next to each other and the coil is made as a single piece. The coil is made of a coated enameled copper wire and comprises between 50 and 70 such turns 36, which are wound around coil core 26.

A first shield 38 is placed flush on first end face 30, wherein first end face 30 is completely covered by first shield 38. In this case, first shield 38 adjoins coil core 26 without a gap. First shield 38 is materially connected, in particular glued, to coil core 26. In other words, first shield 38 adjoins coil core 26 without a gap. First shield 38 is made of a foil and has a planar design. In other words, first shield 38 extends substantially in one plane. The plane is perpendicular to longitudinal direction 34, so that planar first shield 38 is angled to longitudinal direction 34 of coil core 26 by an angle of 90°. The thickness of first shield 38, therefore, its extent in longitudinal direction 34, is substantially equal to 0.2 mm and the first shield is made of a MnZn-ferrite foil. Thus, the material of first shield 38 has an electrical conductivity of substantially 10 S/m and a magnetic permeability $\mu_R$ greater than 200. In summary, first shield 38 is made of a ferrimagnetic or ferromagnetic material.

A second shield 40 is placed flush on second end face 32. In other words, the distance between first shield 38 and second shield 40 and coil 26 in each case is smaller than 300 μm. Second shield 40 is structurally identical to first shield 38 and is made of the same material. In other words, second shield 40 has the same electrical and magnetic properties as first shield 38. Second shield 40 is arranged symmetrically with respect to first shield 38, so that when the two shields 38, 40 are projected onto a mirror plane that is perpendicular to longitudinal direction 34, the two projections overlap. Second shield 40 is thus arranged parallel to first shield 38. In summary, second shield 40 is also made of the ferrimagnetic or ferromagnetic material and extends at an angle to longitudinal direction 34 of coil core 26. In this case, the two shields 38, 40 extend wing-like from the respective end 30, 32 along each spatial direction.

At bottom side 42 of first shield 38, said bottom side facing coil core 26, a first layer 44 is connected, in particular fixed and preferably glued, to first shield 38 without a gap. In other words, first layer 44 is arranged at a distance of less than 500 μm to first shield 38. First layer 44 also has a planar design and covers bottom side 42 of first shield 38 in a region which is spaced apart from coil core 26. Here, first layer 44 is applied flat to first shield 38 and has a thickness, therefore, an extent in longitudinal direction 34, of 0.05 mm. First layer 44 is made of a paramagnetic aluminum foil and thus has an electrical conductivity of $37.7 \cdot 10^6$ S/m, wherein the magnetic permeability is less than 2.

As an alternative to the aluminum foil, for example, a copper foil is used. Thus, the material of first layer 44 is a diamagnetic material. In further alternatives, first layer 44 comprises or consists of low-permeability iron, low-permeability stainless steel such as MAGNADUR 3952, cobalt, and/or nickel. However, at least the magnetic permeability of first layer 44 is less than 1000, and the electrical conductivity is greater than $10^6$ S/m, and the material is either paramagnetic or diamagnetic.

Antenna 18 further has a second layer 46 made of the same material as first layer 44 and thus having the same magnetic and electrical properties. Also, second layer 46 is made of the same foil as first layer 44 and connected to second shield 40 in the same manner as first layer 44. Second layer 46 is thus fixed to bottom side 47 facing coil core 26 and first shield 38.

Second layer 46 is arranged relative to first layer 44 symmetrically with respect to a mirror plane, which is arranged perpendicular to longitudinal direction 34. In other words, the two layers 44, 46 face each other. First layer 44 and second layer 46 are electrically contacted by a shorting bar 48 which extends along bottom side 42 of first shield 38 and bottom side 47 of second shield 40 and along coil core 26 in the region free of turns 36. Planar shorting bar 48 spans turns 36 on the outside, which is why it does not run inside the coil formed by turns 36.

A first antenna system, which is used for producing the inductive wireless radio communication 20, is formed by coil core 26, turns 36, and first shield 38 and second shield 40. In this case, turns 36 are suitably supplied with an alternating current, so that magnetic field lines 50 form, only two of which are shown by way of example. These are formed by the two shields 38, 40.

An interspace 52, in which the number of magnetic field lines 50 is reduced due to the material of the two layers 44, 46, is formed between the two layers 44, 46. A further component 54 or further components, which interfere electromagnetically, in particular traces, a capacitor, or a digital signal processor, are arranged in interspace 52. In a variant, a part of signal processing unit 12 is located in interspace 52. In other words, further component 54 is part of signal processing unit 12. Magnetic field lines 50 are drawn into the two shields 38, 40 due to the material of the two layers 44, 46, which increases the transmission quality or reception quality of antenna 18. However, any eddy currents are predominantly formed within layers 44, 46, and the two shields 38, 40 are substantially free of eddy currents, which results in a reduced power requirement and an increased figure of merit if a further component 54 is present.

A second antenna system, which is used for electromagnetic wireless radio communication 24, is provided by the two layers 44, 46 and shorting bar 48. In this case, both radio communications 20, 24 can be operated at the same time. In inductive wireless radio communication 20, the selected frequency range is between 100 kHz and 30 MHz, and the frequency range between 1 GHz and 6 GHz is used in electromagnetic wireless radio communication 24. In a further operating mode, antenna 18 and in particular turns 36 and coil core 26 are used for inductive power transfer and thus for charging battery 16.

Figure 3:
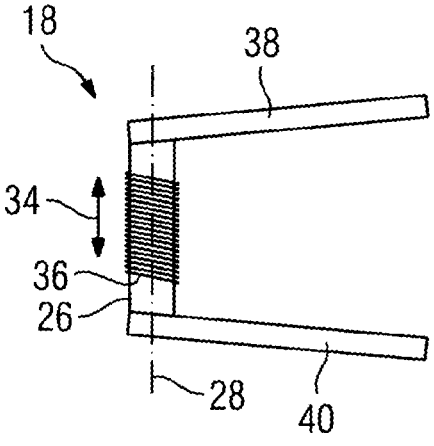

A variation of antenna 18 is shown in FIG. 3, wherein, for example, the two layers 44, 46 are omitted. However, these are present in a further alternative, as is shorting bar 48 and further component 54. First shield 38 is angled with respect to longitudinal direction 34 at an angle of 80°, and second shield 40 as well is also angled at an angle of 80°, wherein the two shields 38, 40 are not parallel to each other and therefore enclose an angle of 20° to each other. Thus, the extent of antenna 18 in longitudinal direction 34 is increased, so that a quality of antenna 18 is further improved.

Figure 4:
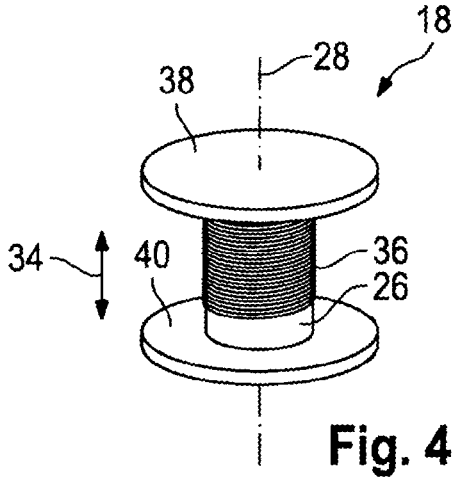

In FIG. 4, antenna 18 is shown in perspective in a further embodiment.

First shield 38 and second shield 40 are again arranged parallel to each other and perpendicular to longitudinal direction 34 of coil body 26, which carries an increased number of turns 36. In addition, first shield 38 and second shield 40 have a circular cross section perpendicular to longitudinal direction 34, and coil core 26 as well has a circular cross section perpendicular to longitudinal direction 34. Coil core 26 has a diameter between 1.0 and 1.5 mm, and coil core 26 is arranged concentric with the two shields 38, 40. In other words, the centers of circular shields 38, 40 lie on longitudinal axis 28, with respect to which coil core 26 is rotationally symmetric. Coil core 26 is hollow in a further alternative. The two layers 44, 46 are not shown but are present in a further alternative. Here, the two layers 44, 46 are annular and radially slotted, so that they are not rotationally symmetric with respect to longitudinal direction 34. This avoids excessive formation of eddy currents in the respective layers 44, 46, which would otherwise lead to a deterioration in quality. Also, the length of coil core 26 in longitudinal direction 34 is between 2 mm and 8 mm and, for example, equal to 5 mm.

Figure 5:
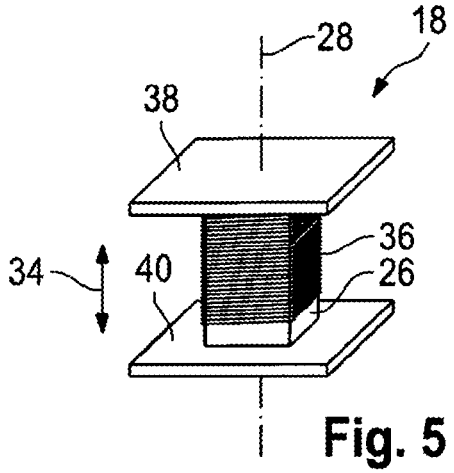

A further embodiment of antenna 18 is shown in FIG. 5. As a variation to the embodiment shown in FIG. 4, the cross section of the mutually parallel shields 38, 40 perpendicular to longitudinal direction 34 is rectangular or square. The cross section of coil core 26 as well is rectangular, and coil core 26 thus has cuboid form. The extent of the coil core in longitudinal direction 34 in the illustrated example is equal to 4 mm, and one side of the rectangular cross section has a length between 0.05 mm and 3.0 mm or between 0.05 mm and 2.5 mm and the other side has a length between 0.3 mm and 8 mm. In particular, the lengths here are between 0.3 mm and 1.5 mm or between 1 mm and 5 mm.

Figure 6:
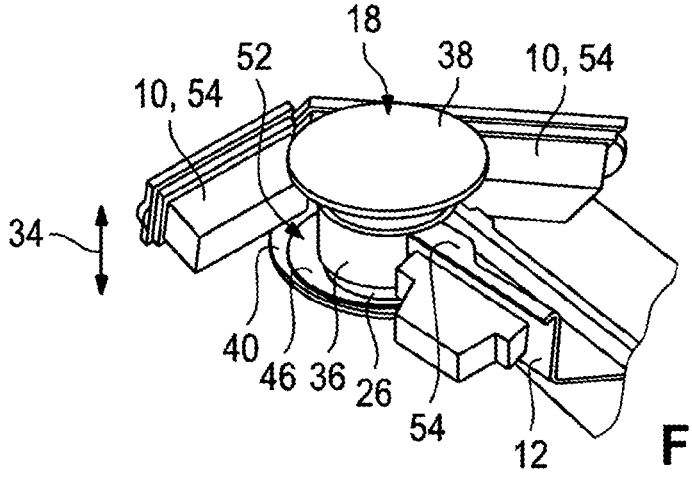

A further embodiment of antenna 18 is shown in FIG. 6, wherein the two shields 38, 40 are substantially elliptic. The two shields 38, 40 project over coil body 26 perpendicular to longitudinal direction 34 in each direction, and each bottom side 42, 47, with the exception of the direct contact with coil body 26 and the substantially radially extending slot, is provided in each case with layer 44, 46. As a result, an interspace 52 is formed which substantially surrounds coil body 26 and in which a plurality of further components 54 are arranged. Here, further components 54 include the two electromechanical sound transducers 10 as well as parts of signal processing unit 12. In addition, coil body 26 has a chamfer extending in longitudinal direction 34 and not shown in detail, within which an edge of a printed circuit board of signal processing unit 12 is arranged; this makes efficient use of the installation space. Antenna 18 is also stabilized in this way.

Figure 7:
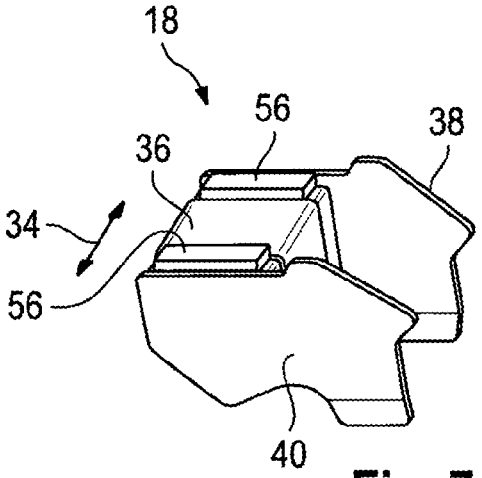
Figure 8:
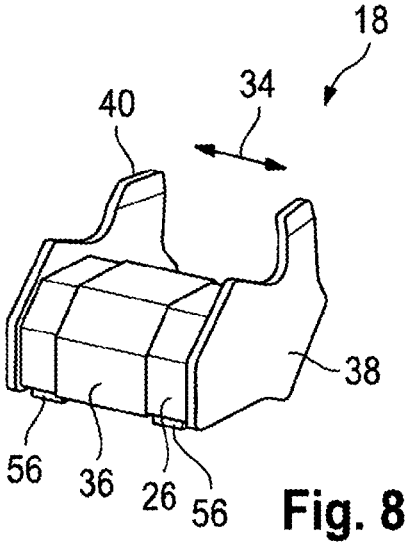

A further embodiment of antenna 18 is shown in FIGS. 7 and 8 in each case in perspective. Coil core 26 is pentagonal in shape, and the first and second shields 38, 40 have an irregular shape. The two shields 38, 40 are parallel to each other and symmetric with respect to a plane of symmetry that is perpendicular to longitudinal direction 34. Furthermore, the antenna comprises two terminals 56 which are each electrically contacted with one of turns 36. Terminals 56 are copper strips and are used for the electrical contacting of antenna 18 with signal processing unit 12.

Figure 9:
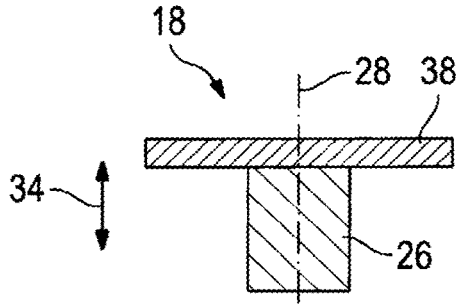

In FIG. 9, an embodiment of antenna 18 is shown in part in a sectional view along longitudinal axis 28. First shield 38 is placed flush on coil core 26, wherein the distance in longitudinal direction 34 is less than 300 μm. First shield 38, however, is spaced from coil core 26, for example, in particular due to an adhesive layer. In the shown example, first shield 38 is fabricated of low-permeability iron. However, a low-permeability stainless steel or another ferromagnetic or ferrimagnetic material can also be used. In addition, it is possible that second shield 40 and the two layers 44, 46 are present, which, however, are not shown, any more than turns 36.

Figure 10:
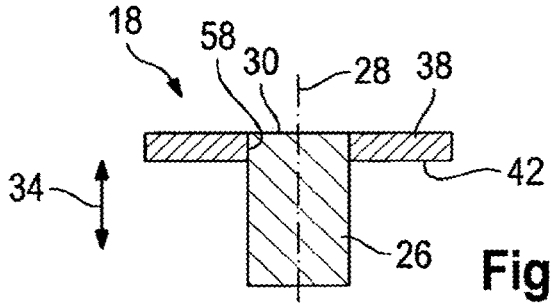

FIG. 10 shows a variation of antenna 18 shown as a partial view in FIG. 9. First shield 38 has a recess 58 in which coil core 26 is inserted to form a clearance fit. End face 30 is flush with the surface of first shield 38, said surface facing away from bottom side 42. In other words, first shield 38 is mortised with end face 30 of coil core 26.

Figure 11:
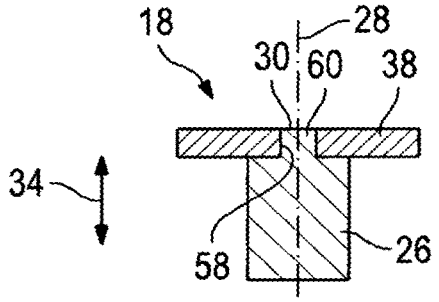

A further variation of antenna 18, shown in FIG. 10, is shown in FIG. 11. Recess 58, which is concentric to longitudinal axis 28, is designed reduced in size, and coil core 26 has a tenon 60, which is reduced in cross section, at the end, facing end face 30, in longitudinal direction 34. The cross section of tenon 60 perpendicular to longitudinal direction 34 is reduced in comparison with the cross section of coil core 26, which is spaced from first shield 38. In other words, coil core 26 is designed step-shaped in the region of end face 30. The cross section of tenon 60 corresponds to recess 58, and the extent of tenon 60 in longitudinal direction 34 is equal to the thickness of first shield 38, so that coil core 26 is set relatively stably on first shield 38.

Figure 12:
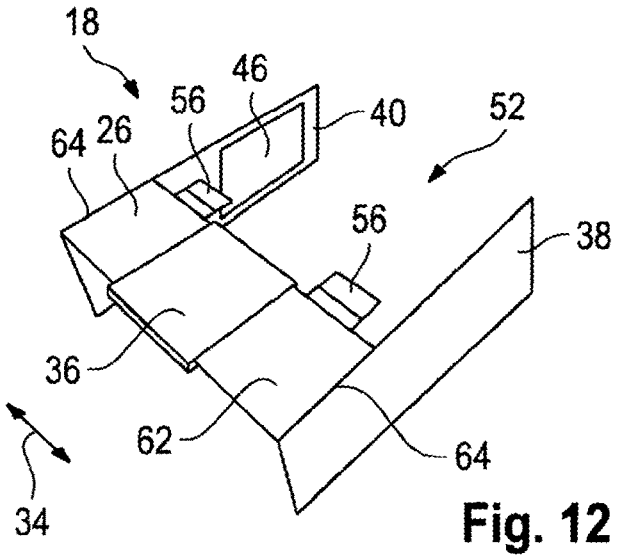
Figure 13:
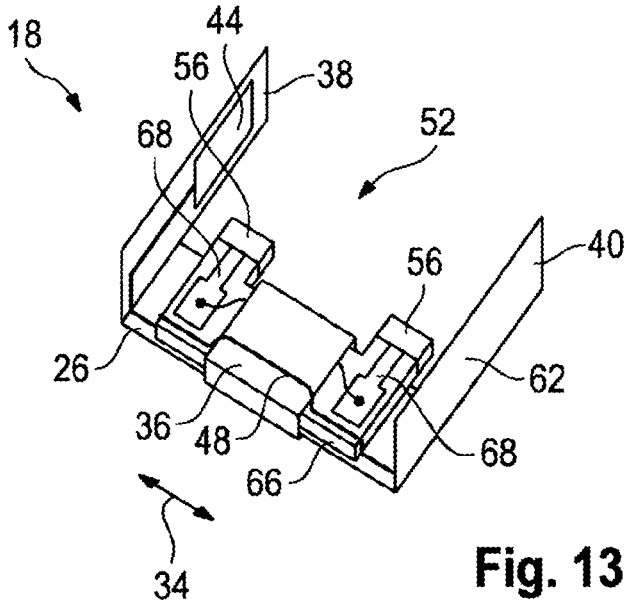

FIG. 12 shows a further embodiment of antenna 18 perspectively in a top plan view and in FIG. 13 in a bottom view. Antenna 18 has a foil structure 62, by means of which coil core 26 and first shield 38 and second shield 40 are formed. Foil structure 62 made of a ferrite is designed as a single layer and is substantially made in a U-shape, into which two folds 64 are introduced, so that the two shields 38, 40 extend at an angle to longitudinal direction 34. In a further alternative, first shield 38 and coil core 26 are each provided with a separate foil, which were mechanically separated from each other, however, and joined together. A printed circuit board 66, which is made of a glass fiber-reinforced epoxy resin, is connected to coil core 26 in the region of turns 36. Circuit board 66 is configured U-shaped and arranged spaced between the two shields 38, 40. The free ends of the U-shaped circuit board 66 project into interspace 52, and turns 36 surround the middle leg of circuit board 66. Circuit board 66 has terminals 56, which are contacted electrically by traces 68 with the coil formed by turns 36. Circuit board 66 is glued in particular to foil structure 62.

The two layers 44, 46 are electrically contacted to each other by shorting bar 58, which is likewise fastened to circuit board 66 and guided peripherally around turns 36, so that shorting bar 58 runs outside the coil formed by turns 36. Due to circuit board 66, coil core 26 is stabilized in the region of turns 36. In other words, coil core 26 is not pliable in the region, which is why attaching turns 36 is simplified. In addition, the position of turns 36 is stabilized due to the U-shape of circuit board 66, which is spaced from the two shields 38, 40.

Figure 14:
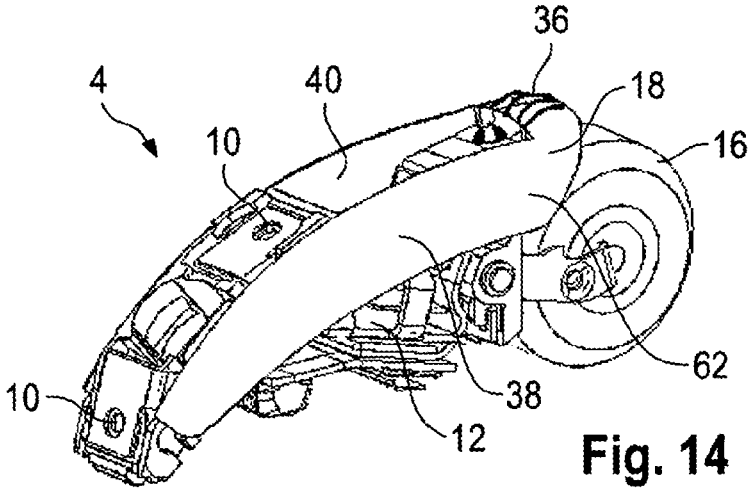
Figure 15:
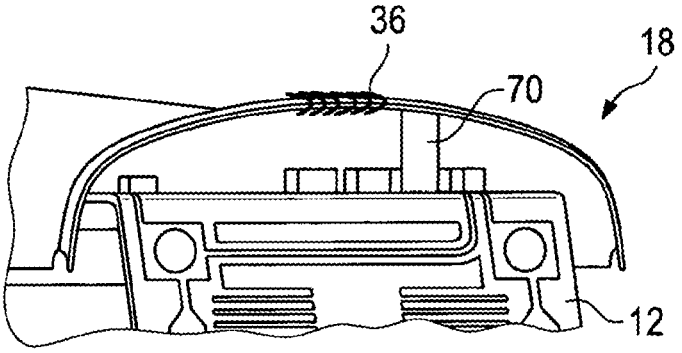

In FIG. 14, one of the hearing devices 4 is shown perspectively without housing 6 with a further embodiment of antenna 18 in a partial view, wherein it is also comprised of foil structure 62. The two shields 38, 40 are made wing-like and slightly curved, but nevertheless planar. In FIG. 15, the embodiment of the antenna is shown in a further perspective. Antenna 18 has a ground connection 70, which is electrically contacted with coil core 26 or shorting bar 48. By means of ground connection 70, coil core 26 or shorting bar 48 is electrically taken to a device ground of hearing device 4. Thus, the impedance can be adjusted, which is why a resonant circuit formed by antenna 18 can be set to a specific resonant frequency. Ground connection 70 is electrically contacted with signal processing unit 12 via which the device ground is provided.

Figure 16:
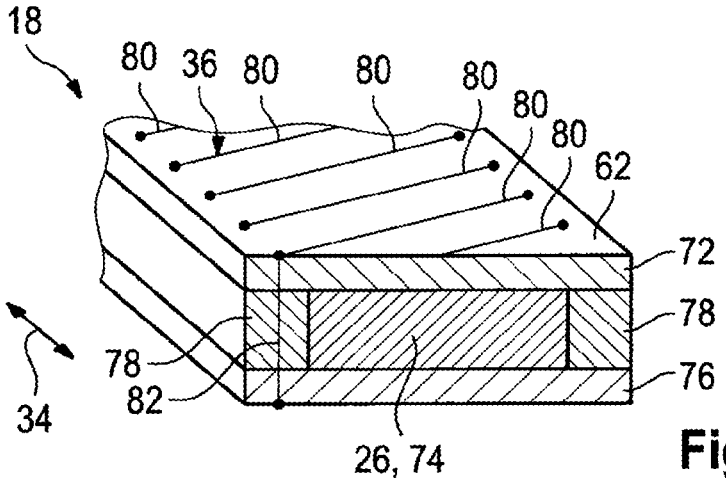

FIG. 16 shows a further embodiment of antenna 18, wherein only coil core 26 is shown in a sectional view perpendicular to longitudinal direction 34. Coil core 26 and the two shields 38, 40 are formed as the continuous foil structure 62, which is, however, designed as three layers. Foil structure 62 thus has a first layer 72, a second layer 74, and a third layer 76, which are designed substantially planar and stacked one above the other, wherein second layer 74 is arranged between first layer 72 and third layer 76. First layer 72 and third layer 76 are congruent, whereas second layer 74 is made smaller and is spaced from an edge region of foil structure 62. The edge region is formed by two auxiliary layers 78, which are likewise arranged between first layer 72 and third layer 76. The composite of second layer 74 and auxiliary layers 78 is congruent with first layer 72 and third layer 76. Thus, second layer 74 is completely shielded from the environment. First layer 72, second layer 74, third layer 76, and auxiliary layers 78 are fastened to one another by means of lamination.

Second layer 74 is made of a soft magnetic ferrite and forms coil core 26. First layer 72 has traces 80 which are electrically insulated from each other and which are applied to an electrically insulating carrier of first layer 72, and which are spaced from second layer 74. Traces 80 of first layer 72 extend transversely to longitudinal direction 34 and are substantially rectilinear. Each trace 80 of first layer 72 is electrically contacted at its end by vias 82, only one of which is shown and which passes through auxiliary layers 78, with traces of third layer 76, which are perpendicular or also transverse to longitudinal direction 34 but are inclined in the opposite direction to traces 80 of first layer 72. Turns 36 are created by means of traces 80 of first layer 72 and the traces of third layer 76 and vias 82, and antenna 18 is also designed to be flexible in the region of coil core 26. One of the terminals 56 is also at least partially formed by means of at least one of the traces. In a further alternative, first shield 38 and coil core 26 are provided by means of a foil, but are mechanically separated from each other.

Figure 17:
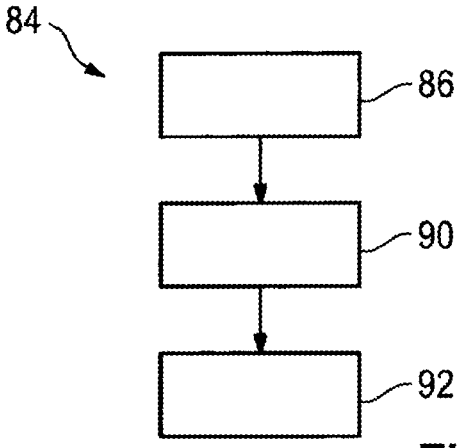
FIG. 17 shows a method for manufacturing the antenna.
Figure 18:
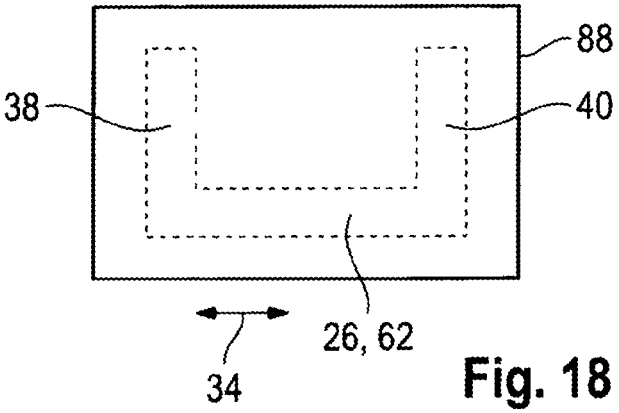
FIG. 18 shows schematically a sheet or bulk product.

A method 84 for manufacturing antenna 18 having foil structure 62 is shown in FIG. 17. In a first step 86, a foil-like sheet or bulk product 88 is provided, which is shown by way of example in FIG. 18. The dimension of the sheet is, for example, greater than 30 cm by 30 cm, or the bulk product has a width of at least 10 cm and, for example, a length of over 1 m. Sheet or bulk product 88 is formed by a foil. In other words, the foil is available as a sheet or bulk product 88. Sheet or bulk product 88 is designed either single-layered or multi-layered, for example, three-layered, wherein this is provided depending on the embodiment of the antenna. Thus, for example, the sheet or bulk product is made in three layers for antenna 18 shown in FIG. 16.

In a second step 90, foil structure 62 is cut out of sheet or bulk product 88 by means of punching. Following this, for example, circuit board 66 is attached to the sheet-like foil structure 62 or vias 82 are created. In particular, in second step 90, turns 36 are created, wherein these are suitably electrically contacted with terminals 56. In a subsequent third step 92, first shield 38 and second shield 40, which are each formed by means of the two mutually parallel legs of the U-shaped foil structure 62, are angled with respect to coil core 26, which is formed by means of the connecting leg. Thus, the two shields 38, 40 are angled to longitudinal direction 34 of coil core 28. For this purpose, for example, folds 64 are introduced into foil structure 62.

The invention is not limited to the exemplary embodiments described above. Rather, other variants of the invention can also be derived herefrom by the skilled artisan, without going beyond the subject of the invention. Particularly, further all individual features described in relation to the individual exemplary embodiments can also be combined with one another in a different manner, without going beyond the subject of the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims

What is claimed is:

1. An antenna for a hearing device for wireless radio communication, the antenna comprising:

a coil core extending along a longitudinal direction and carrying a number of turns;

a planar first shield arranged on a first end face of the coil core, the planar first shield being made of a ferrimagnetic and/or ferromagnetic material and extends at an angle to the longitudinal direction of the coil core; and a planar second shield arranged on a second end face of the coil core, the planar second shield being made of a ferrimagnetic and/or ferromagnetic material and extending at an angle to the longitudinal direction of the coil core and extending in a same direction as the planar first shield.

2. The antenna according to claim 1, wherein the first shield adjoins the coil core without a gap.

3. The antenna according to claim 1, wherein the first shield is mortised with the end face of the coil core via a tenon of the coil core, said tenon being reduced in cross section.

4. The antenna according to claim 1, wherein the first shield has a thickness between 0.05 mm and 0.7 mm.

5. The antenna according to claim 1, wherein a material of the first shield has an electrical conductivity of $\sigma<10^6$ S/m.

6. The antenna according to claim 1, wherein a first layer made of a material having a magnetic permeability of $\mu_r$ less than 1000 is arranged on a bottom side of the first shield, and wherein the bottom side faces the coil core.

7. The antenna according to claim 6, wherein the material of the first layer is a paramagnetic material or a diamagnetic material.

8. The antenna according to claim 6, wherein the first layer is attached without a gap to the bottom side of the first shield.

9. The antenna according to claim 6, wherein the electrical conductivity of the material of the first layer is greater than $10^6$ S/m.

10. The antenna according to claim 6, wherein the first layer is a foil.

11. The antenna according to claim 1, wherein the length of the coil core in the longitudinal direction is between 2.0 mm and 8.0 mm.

12. The antenna according to claim 1, wherein the coil core has a round cross section substantially perpendicular to the longitudinal direction, and wherein the diameter is between 0.05 mm and 3.0 mm.

13. The antenna according to claim 1, wherein the coil core has a rectangular cross section perpendicular to the longitudinal direction, and wherein a first side has a length of between 0.05 mm and 2.5 mm and a second side has a length of between 0.3 mm and 8.0 mm.

14. The antenna according to claim 1, wherein the first shield and the coil core are formed as a continuous folded foil structure.

15. The antenna according to claim 14, wherein a printed circuit board is connected to the coil core in a region of the turns.

16. The antenna according to claim 14, wherein the foil structure has a first layer, a second layer, and a third layer stacked on top of each other, and wherein the coil core is formed by the second layer and the turns are formed by the first layer and the third layer.

17. A method for manufacturing an antenna, the method comprising:

providing a U-shaped foil-like sheet or bulk product;

removing the foil structure from the sheet material or bulk product;

forming a coil core extending along a longitudinal direction and creating a number of turns of the coil core;

forming a planar first shield arranged on a first end face of the coil core, the planar first shield being made of a ferrimagnetic and/or ferromagnetic material and extending at an angle to the longitudinal direction of the coil core and a planar second shield arranged on a second end face of the coil core, the planar second shield being made of a ferrimagnetic and/or ferromagnetic material and extending at an angle to the longitudinal direction of the coil core, the planar first shield and the planar second shield being formed from two mutually parallel legs of the U-shaped foil-like sheet or bulk product.

18. A hearing device, in particular a hearing aid, comprising an antenna according to claim 1.

19. The antenna according to claim 1, wherein the first shield extends at an angle between 45° and 135° to the longitudinal direction of the coil core.

20. The antenna according to claim 1, wherein a material of the first shield has a magnetic permeability of $\mu_r$ greater than 5.

21. The antenna according to claim 1, wherein the planar first shield and the planar second shield are made of a same material and are structurally identical.

22. The antenna according to claim 1, wherein the planar first shield and the planar second shield are made of a MnZn-ferrite foil.

23. The antenna according to claim 1, further comprising a component disposed in a space between the planar first shield and the planar second shield.

24. A hearing device system comprising:

a pair of structurally identical hearing devices; and a remote device configured to communicate with the pair of structurally identical hearing devices, wherein each of the pair of structurally identical hearing devices comprise an antenna, the antenna comprising:

a coil core extending along a longitudinal direction and carrying a number of turns;

a planar first shield arranged on a first end face of the coil core, the planar first shield being made of a ferrimagnetic and/or ferromagnetic material and extending at an angle to the longitudinal direction of the coil core; and a planar second shield arranged on a second end face of the coil core, the planar second shield being made of a ferrimagnetic and/or ferromagnetic material and extending at an angle to the longitudinal direction of the coil core and extending in a same direction as the planar first shield.

* * * * *